US010544718B2

(12) United States Patent
Kirschner et al.

(10) Patent No.: US 10,544,718 B2
(45) Date of Patent: Jan. 28, 2020

(54) METHOD FOR CONTROLLING A PRESSURE IN A CRANKCASE

(71) Applicant: Mahle International GmbH, Stuttgart (DE)

(72) Inventors: Volker Kirschner, Muehlacker (DE); Robert Lepper, Leonberg (DE); Thomas Riemay, Korb (DE)

(73) Assignee: Mahle International GmbH (DE)

( * ) Notice: Subject to any disclaimer, the term of this patent is extended or adjusted under 35 U.S.C. 154(b) by 0 days.

(21) Appl. No.: 16/093,379

(22) PCT Filed: Mar. 15, 2017

(86) PCT No.: PCT/EP2017/056105
§ 371 (c)(1),
(2) Date: Oct. 12, 2018

(87) PCT Pub. No.: WO2017/178183
PCT Pub. Date: Oct. 19, 2017

(65) Prior Publication Data

US 2019/0211721 A1 Jul. 11, 2019

(30) Foreign Application Priority Data

Apr. 14, 2016 (DE) ..... 10 2016 206 285

(51) Int. Cl.
*F01M 11/10* (2006.01)
*F01M 13/02* (2006.01)
*F01M 13/00* (2006.01)

(52) U.S. Cl.
CPC ..... *F01M 11/10* (2013.01); *F01M 13/0011* (2013.01); *F01M 13/02* (2013.01);
(Continued)

(58) Field of Classification Search
CPC .... F01M 11/10; F01M 13/0011; F01M 13/02; F01M 2013/026; F01M 13/021;
(Continued)

(56) References Cited

U.S. PATENT DOCUMENTS 8,607,767 B2 12/2013 Ruppel et al.
2003/0233932 A1 12/2003 Ekeroth
(Continued)

FOREIGN PATENT DOCUMENTS

DE 10153120 A1 9/2002
DE 20302824 U1 7/2004
(Continued)

OTHER PUBLICATIONS

English abstract for DE-10153120.
English abstract for DE-20318633.
English abstract for EP-2166202.

*Primary Examiner* — Jacob M Amick
(74) *Attorney, Agent, or Firm* — Fishman Stewart PLLC

(57) ABSTRACT

A method for controlling a pressure in a crankcase of an internal combustion engine with a crankcase venting device. The crankcase venting device may include a suction line via which a blow-by gas is removable from the crankcase, a pumping device, and an oil mist separating device. The pumping device and the oil mist separating device may be arranged in the suction line. The method may include controlling a rotational speed of an electric drive in at least one of a closed-loop manner and an open-loop manner, the electric drive configured to drive the pumping device. The method may also include adjusting the pressure in the crankcase via manipulating the rotational speed of the electric drive. The method may further include inferring the pressure in the crankcase via evaluating at least one performance parameter of the electric drive.

20 Claims, 5 Drawing Sheets

(52) U.S. Cl.
CPC ..... *F01M 2011/1446* (2013.01); *F01M 2013/0005* (2013.01); *F01M 2013/026* (2013.01); *F02D 2250/08* (2013.01)

(58) Field of Classification Search
CPC ... F01M 2013/0005; F01M 2011/1446; F01M 2013/005; F01M 2013/0077; F01M 2013/0083; F01M 2013/0088; F01M 2013/0094; F02D 2250/08
See application file for complete search history.

(56) References Cited

U.S. PATENT DOCUMENTS

| | | | | |
|---|---|---|---|---|
| 2004/0112346 | A1* | 6/2004 | Ahlborn ..... | F01M 13/021 123/572 |
| 2009/0223496 | A1* | 9/2009 | Borgstrom ..... | B01D 45/14 123/573 |
| 2015/0020785 | A1* | 1/2015 | An ..... | F01M 13/02 123/572 |

FOREIGN PATENT DOCUMENTS

| | | | |
|---|---|---|---|
| DE | 20318633 | U1 | 4/2005 |
| DE | 102006024816 | A1 | 12/2007 |
| EP | 2166202 | A1 | 3/2010 |
| EP | 2079905 | B1 | 4/2010 |
| EP | 2698510 | A1 | 2/2014 |
| WO | 2009116897 | A1 | 9/2009 |
| WO | 2012036547 | A1 | 3/2012 |

* cited by examiner

METHOD FOR CONTROLLING A PRESSURE IN A CRANKCASE

CROSS-REFERENCE TO RELATED APPLICATIONS

This application claims priority to International Patent Application No. PCT/EP2017/056105, filed Mar. 15, 2017, and German Patent Application No. DE 10 2016 206 285.9, filed on Apr. 14, 2016, the contents of both of which are hereby incorporated by reference in their entirety.

TECHNICAL FIELD

The invention relates to a method for controlling a pressure to a target pressure in a crankcase of an internal combustion engine by means of a crankcase venting device, wherein the crankcase venting device comprises a suction line, by means of which blow-by gas can be removed from the crankcase, a pumping device driven by an electric drive and an oil mist separating device, and wherein the pumping device and the oil mist separating device are arranged in the suction line. The invention further relates to an internal combustion engine with a crankcase venting device wherein such a method is carried out.

BACKGROUND

In internal combustion engines, particularly reciprocating internal combustion engines, "blow-by" gas stream is created due to the imperfect seal between the piston and the cylinder wall. These blow-by gases are thus able to get into the crankcase and must therefore be vented from the crankcase again. At the same time, it is critically important that the pressure in the crankcase remains within certain limits. If the pressure in the crankcase is too high, oil from the crankcase may escape from the engine block through gaskets. If the pressure is too low, oil may be sucked out of the crankcase by the crankcase venting device. Both cases are undesirable, so the pressure in the crankcase must be kept within certain limits.

The blow-by gases vented from the crankcase typically contain an oil mist, which must be separated in an oil mist separating device if the loss of oil due to the crankcase venting device is to be minimised. A certain differential pressure is needed for the oil mist separating device, and when the internal combustion engine is not under load this is supplied by the pressure difference between the crankcase and an intake tract of the internal combustion engine behind a throttle in which a negative pressure prevails. When the internal combustion engine is under load, there is not enough of this negative pressure available. For this reason, crankcase venting devices with additional pumping devices are known.

Such a crankcase venting device with an additional pumping device is known from DE 10 2006 024 816 A1 for example. However, the output of the pumping device must be controlled so that the pressure in the crankcase does not exceed the permitted limits. This is why a pressure measuring device is typically provided in the crankcase.

SUMMARY

The problem underlying the present invention is to provide an improved method for controlling a pressure to a target pressure in a crankcase, or at least another form thereof, which is characterized particularly in that a pressure measuring device is not necessary in the crankcase.

This problem is solved according to the invention with the objects of the independent claim(s). Advantageous further developments constitute the objects of the dependent claim (s).

The invention is based on the general idea of deriving information about the pressure in the crankcase from parameters of the electric drive which drives the pumping device. In this way, the pressure in the crankcase may be maintained in a certain target range without an additional pressure measurement in the crankcase. It is therefore provided according to the invention, that a rotational speed of the electric drive is controlled in a closed-loop and/or open-loop manner, the rotational speed of the electric drive is used as a manipulated variable for the control of the pressure in the crankcase, and at least one performance parameter of the electric drive is evaluated in order to infer the pressure in the crankcase. The pressure has a significant effect on the work the pumping device must perform, so that conclusions may be drawn about the pressure in the crankcase from the performance parameters of the electric drive. This in turn may be used to control the pressure in the crankcase to a target pressure or at least maintain the pressure within a target pressure range. Specifically, a pressure sensor is not needed in the crankcase. In this context, it is not necessary to determine an absolute, exact value for the pressure in the crankcase. For example, it is sufficient if the performance parameters of the electric drive make it possible to determine whether the pressure in the crankcase is too high or too low.

In the description and the accompanying claims, a performance parameter of the electric drive is understood to refer to a parameter which is at least partially involved in determined the power that is output or consumed by the electric drive. In particular, such performance parameters of the electric drive include the electrical current supplied to the electric drive, preferably an electrical current calculated over a period of time, an electrical voltage incident on the electric drive, preferably an electrical voltage calculated over a period of time, an electrical power consumption of the electric drive, preferably an electrical power consumption calculated over a period of time, a rotational speed of the electric drive and a torque of the electric drive.

One advantageous solution provides that an actual current value corresponding to a current supplied to the electric drive is compared with a current setpoint, and a rotational speed correction value is determined for the rotational speed of the electric drive if a difference exists between the actual current value and the current setpoint. The pressure difference the pumping device must overcome can be inferred from the actual current value needed in order to maintain the rotational speed of the electric drive. When the pressure difference is low, the pumping device must deliver less power than when the pressure difference is higher. The electrical power consumption of the electric drive also behaves in the same way. Consequently, it is possible to determine whether the rotational speed of the electric drive must be adjusted from the comparison of the actual current value with a current setpoint.

In the description and the accompanying claims, an actual current value is understood to mean a measured value of the current that is supplied to the electric drive.

A further advantageous solution provides that the current setpoint corresponds to a value for the current supplied to the electric drive which would be necessary to maintain the rotational speed of the electric drive at a given rotational speed of the electric drives and pressure corresponding to the target pressure in the crankcase. Thus, it is possible to determine from a deviation between the actual current value and the current setpoint if the pressure in the crankcase does not correspond to the target pressure. On this basis, it may be decided that the rotational speed of the electric drive must be adjusted to shift the pressure in the crankcase so that it is closer to the target pressure.

A particularly advantageous solution provides that the current setpoint is determined from characteristic curves of the electric drives and the pumping device. This enables a theoretical current setpoint to be determined, the current setpoint may also be determined experimentally alternatively or additionally thereto.

One favourable variant provides that a torque generated by the electric drive and acting on the pumping device is determined, that a rotational speed actual value of the pumping device corresponding to the rotational speed of the pumping device is determined, a pressure differential generated by the pumping device and a volume flow flowing through the pumping device are determined from the torque acting on the pumping device and the actual rotational speed value of the pumping device, particularly with the aid of a characteristic curve for the pumping device. The pressure in the crankcase may be inferred from the pressure differential generated and the volume flow created, thus enabling the pressure in the crankcase to be controlled.

One advantageous option provides that a current supplied to the electric drive is taken into account for determining the torque generated by the electric drive, and that if a transmission is present via which the electric drive is coupled to the pumping device, a gear ratio is considered. The actual current value is technically easy to measure, and it is therefore simple to obtain information on the torque using the actual current value.

A further advantageous option provides that for determining the rotational speed of the pumping device, the rotational speed of the pumping device is measured at the pumping device, or that the rotational speed of the electric drive is measured, wherein, if a transmission is present via which the electric drive is coupled to the pumping device, a gear ratio is taken into account. Rotational speed measurements can be carried out very easily. The rotational speed of the electric drive may also be read out from a controller of the electric drive, for example.

A further particularly advantageous option provides that a drop in pressure at the oil mist separating device is determined from the volume flow, that information about the pressure in the crankcase may be inferred from the drop in pressure at the oil mist separating device and the pressure differential generated by the pumping device. The one end of the suction line is usually open towards the intake tract, in which the prevailing pressure is substantially ambient pressure. In this way, if all pressure differential generated in the suction line are known, information may be inferred about the pressure in the crankcase, thus enabling the pressure in the crankcase to be controlled.

A favourable solution provides that a control deviation is determined for the pressure in the crankcase, that a rotational speed correction value is determined for the rotational speed of the electric drive on the basis of the control deviation for the pressure in the crankcase. The rotational speed of the electric drive determines the pump capacity of the pumping device and therewith the volume flow of the blow-by gas which is removed from the crankcase. In this way, the pressure in the crankcase can be influenced by varying the rotational speed of the electric drive. The rotational speed correction value is preferably determined in a proportional-integral, a proportional-differential or a proportional-integral-differential (PI, PD or PID) control method.

A further favourable solution provides that a notional blow-by gas volume flow produced by the internal combustion engine is determined from a rotational speed of the internal combustion engine and a torque generated by the internal combustion engine, that an estimated rotational speed value determined on the basis of the notional blow-by gas volume flow produced by the internal combustion engine is determined, so that the notional volume flow displaced by the pumping device matches the notional blow-by gas volume flow generated by the internal combustion engine. This enables the rotational speed of the electric drive to be controlled approximately. The pressure in the crankcase created thereby will be close to the desired target pressure. The control ultimately serves to compensate for deviations arising from manufacturing tolerances, ageing and wear.

A particularly favourable solution provides that the estimated rotational speed value is determined from the blow-by gas volume flow taking into account the characteristic curves of the pumping device and the oil mist separating device. The characteristic curve of the oil mist separating device may be used to determine the magnitude of the drop in pressure at the oil mist separating device for a given blow-by gas volume flow. When the drop in pressure at the oil mist separating device is known, it is possible to determine the magnitude of the pressure differential that is to be generated by the pumping device. Thus, the rotational speed at which the pumping device would have to rotate may be determined together with the blow-by gas volume flow that is to be displaced. The control compensates for deviations between the real characteristic curves of the pumping device and the oil mist separating device and the theoretical characteristic curves, which arise for example due to ageing and displacement tolerances. The control further compensates for deviations in the actual volume flow in the internal combustion engine which may be caused by manufacturing tolerances and ageing conditions of the internal combustion engine.

An advantageous variant provides that a rotational speed setpoint comprising a rotational speed correction value is supplied to a control device which controls the rotational speed of the electric drive in open-loop and/or closed-loop manner. The rotational speed correction value enables the pressure controller to use the rotational speed of the electric drive to control the pressure in the crankcase in closed-loop manner.

A further advantageous variant provides that the rotational speed setpoint is compiled from the estimated rotational speed value and the rotational speed correction value. Since the rotational speed setpoint also comprises the estimated rotational speed value, the determination of the estimated rotational speed value described previously may accelerate control of the pressure, since the rotational speed can be corrected by the estimated rotational speed value when there is a change in the rotational speed of the internal combustion engine or in the torque generated thereby. In this way, the pressure in the crankcase can be controlled more quickly that would be possible via the controller alone.

A favourable option provides that the crankcase venting device has a pressure control valve arranged in the suction line, that a performance parameter of the electric drive is used to determine if the pressure control valve switches, that the switching behaviour of the pressure control valve is taken into account for determining the rotational speed correction value. When controlling the rotational speed, it may be attempted to cause the pressure control valve to actuate regularly. In this way, it may be ensured that sufficient pump capacity is present. It may also serve to prevent the pressure control valve from being closed for too long. This would waste energy unnecessarily. The switching behaviour of the pressure control valve may be detected by monitoring a performance parameter of the electric drive, since the volume flow is interrupted when the pressure control valve is closed. This has the effect of placing increased load on the electric drive. As a result, the actual current value increases and an actual rotational speed value is reduced. When the pressure control valve is opened, the actual current value and the actual rotational speed value behave inversely in corresponding manner.

The invention is further based on the general idea that an internal combustion engine is embodied with a crankcase venting device and a control device which is designed in such manner that a method according the preceding description is initiated thereby. The advantages of the method described previously may thus be transferred to the internal combustion engine, the preceding description of which is referenced to this extent.

Further important features and advantages of the invention are described in the subclaims, the drawing and the associated description of the figures with reference to the drawing.

Of course, the features identified in the preceding text and those which will be explained hereinafter are usable only in the combinations indicated in each case, but also in other combinations or alone without departing from the scope of the present invention.

Preferred embodiments of the invention are presented in the drawing and are explained in greater detail in the following description, wherein the same reference signs refer to identical or similar or functionally equivalent components.

BRIEF DESCRIPTION OF THE DRAWINGS

In the schematic drawing

DETAILED DESCRIPTION

Figure 1:
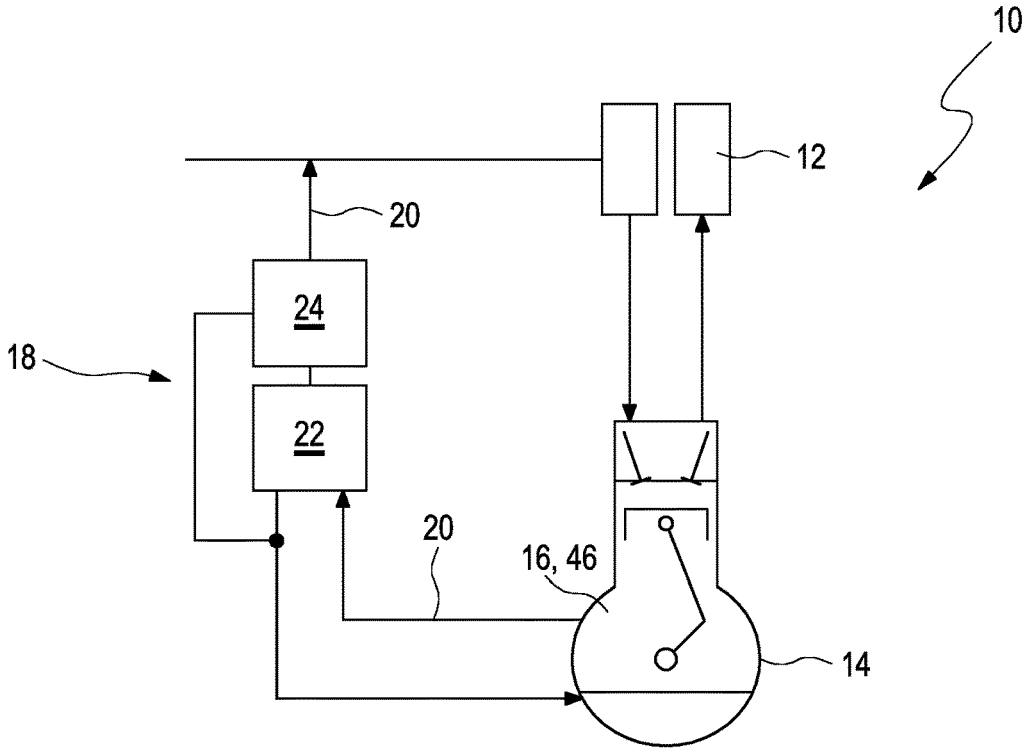
FIG. 1 is a schematic diagram of an internal combustion engine with a crankcase venting device.

An internal combustion engine 10 represented in FIG. 1 has a charging device 12, particularly a turbocharger. The internal combustion engine 10 further has a crankcase 14, in which blow-by gases 16 collect when the internal combustion engine 10 is in operation. In order to remove the blow-by gases 16 from the crankcase 14, the internal combustion engine 10 has a crankcase venting device 18.

The crankcase venting device 18 has a suction line 20, through which blow-by gases 16 may be removed from the crankcase 14. The crankcase venting device 18 further has a pumping device 22 and an oil mist separating device 24, which is embodied for example as an impactor. The pumping device 22 and the oil mist separating device 24 are arranged in the suction line 20, so that the oil mist may be extracted from the blow-by gases 16 before the gases are transported by the pumping device 22 through the suction line 20.

Figure 2:
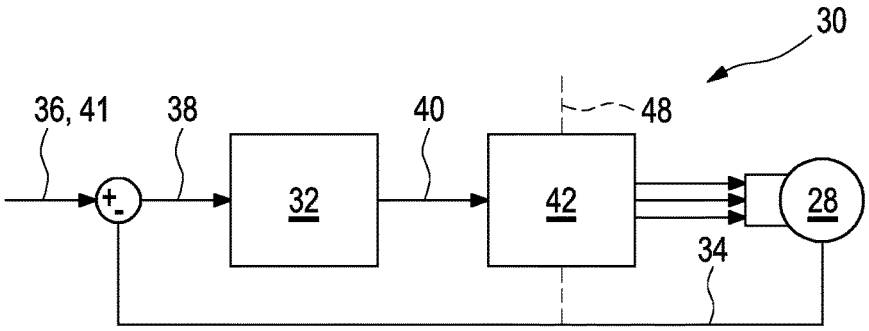
FIG. 2 is a schematic diagram of a rotational speed control of an electric drive.
Figure 3:
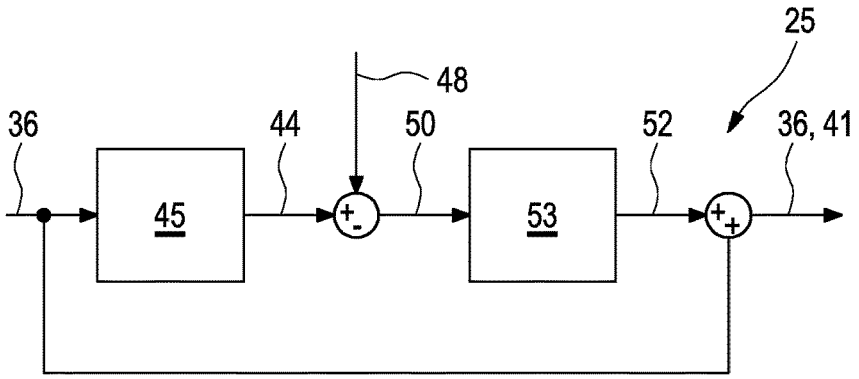
FIG. 3 is a schematic diagram of a control of a pressure in a crankcase of the internal combustion engine according to the first embodiment of the invention.

A pressure 26 in the crankcase 14 of the internal combustion engine 10 should be within a certain range. Malfunctions in the operation of the internal combustion engine 10 can occur if the pressure either exceeds or falls below this range. Therefore, a control 25 of the pressure 26 to a target pressure 27 is provided, hereinafter also referred to as pressure control 25. A first embodiment of the pressure control 25 is represented in FIGS. 1 to 3.

The pumping device 22 is preferably embodied as a side channel blower and driven by an electric drive 28. The electric drive 28 has a rotational speed control 30, such as is represented for example in FIG. 2. The rotational speed control 30 has a standard control schema 32, for example a proportional-integral (PI), or proportional-differential (PD) or proportional-integral-differential (PID) control schema 32. The rotational speed control 30 of the electric drive 28 is assured as follows. First, an actual rotational speed value 34 of the electric drive 28 corresponding to the rotational speed of the electric drive 28 is determined. The actual rotational speed value 34 is preferably measured. The actual rotational speed value 34 is compared with a rotational speed setpoint 36, which serves as an input value for the rotational speed control 30. A control deviation 38 is determined from the difference between the actual rotational speed value 34 and the rotational speed setpoint 36. A new value for a manipulated variable 40 is calculated from the control deviation 38 with the aid of control schema 32 and is supplied to an engine controller 42, which in turn actuates the electric drive 28. Pulse width modulation, an electrical voltage or similar for example may be used as manipulated variables 40.

The rotational speed setpoint 36 serves as the manipulated variable 41 for the actual pressure control 25 of the pressure 26 in the crankcase 14. The pressure control 25 according to the first embodiment is assured as follows. A current setpoint 44 is calculated on the basis of the existing rotational speed setpoint 36. The current setpoint 44 corresponds to a current value which must typically be supplied to the electric drive in order to maintain the rotational speed setpoint 36 under normal operating conditions of the internal combustion engine 10. This is based on the consideration that for a certain blow-by gas volume flow 46, which is to be removed, a rotational speed of the pumping device 22 is sufficient to the remove the given blow-by gas volume flow. As long as the pumping device 22 always has to overcome the same pressure differential to remove the blow-by gas volume flow 46, the current needed to drive the pumping device 22, that is to say the actual current value 48, may be constant. Therefore, when the desired target pressure 27 prevails in the crankcase 14, the current setpoint 44 should be adjusted automatically. If the pressure 26 in the crankcase 14 differs from the target pressure 27, the actual current value 48 should also differ from the current setpoint 44.

The current setpoint 44 may be determined either from theoretical characteristic curves 45 of the electric drive 28, the pumping device 22 and the oil mist separating device 24. Alternatively or in addition thereto, the relationship between the rotational speed setpoint 36 and the current setpoint 44 may also be determined experimentally.

Now for the pressure control 25 of pressure 26, the actual current value 48 is compared with the current setpoint 44, and a control deviation 50 is determined thereby. A rotational speed correction value 52 is determined 53 from the control deviation 50 and is added to the rotational speed setpoint 36 to calculate a new rotational speed setpoint 36, which is supplied to the rotational speed control 30 of the electric drive 28. In this way the control loop is closed and pressure control 25 is achieved.

Figure 4:
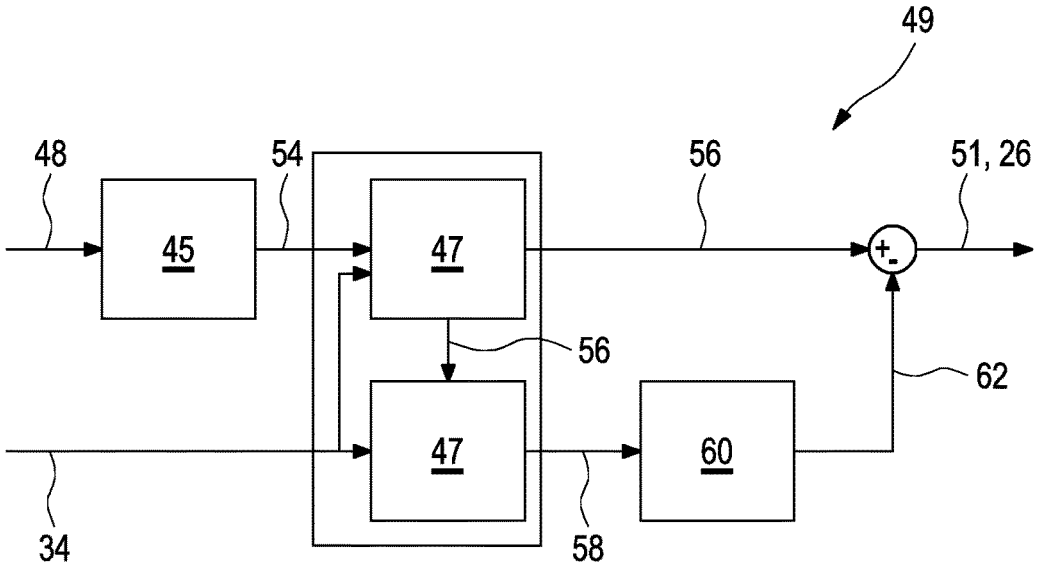
FIG. 4 is a schematic diagram of a determination of a pressure differential in the crankcase venting device on the basis of performance parameters of the electric drive.
Figure 5:
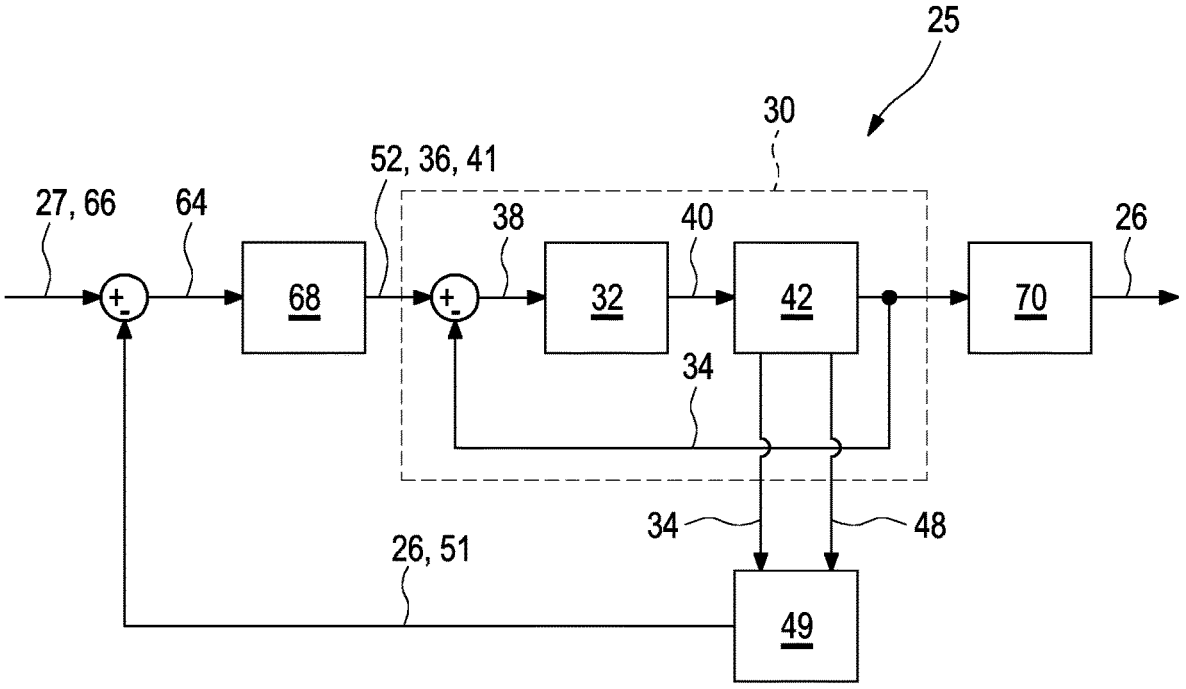
FIG. 5 is a schematic diagram of the control of a pressure in the crankcase according to a second embodiment of the invention.

A second embodiment of the method for pressure control 25 as represented in FIGS. 4 and 5 differs from the first embodiment of the method for pressure control 25 represented in FIGS. 1-3 in that a pressure differential 51 extending over the crankcase venting device 18 is estimated using performance parameters of the electric drive 28 to infer information about the pressure 26 in the crankcase 14 and thus determine a control deviation 64.

In the determination of the pressure differential 51 present at the crankcase venting device 18 represented for example in FIG. 4, first the actual current value 48 and the actual rotational speed value 34 of the electric drive 28 are evaluated. A torque 54 generated by the electric drive 28 may be determined from the actual current value 48. A pressure differential 56 generated by the pumping device 22 may be calculated together with the actual rotational speed value 34 of the electric drive 28, from which the rotational speed of the pumping device 22 can be inferred, with the aid of a characteristic curve 47 of the pumping device 22.

A volume flow 58 displaced by the pumping device 22 and therewith the rotational speed of the pumping device 22 may be estimated from the pressure differential 56 and the actual rotational speed value 34 of the electric drive 28.

A drop in pressure 62 at the oil mist separating device 24 may be inferred from the volume flow 58 displaced by the pumping device 22 with the aid of characteristic curves 60 of the oil mist separating device 24.

Thus, the pressure differential 51 present at the crankcase venting device 18 may be inferred from the pressure differential 56 generated by the pumping device 22 and the drop in pressure 62 at the oil mist separating device 24. Since the suction line 20 typically opens in an area of an intake tract of the internal combustion engine 10 in which ambient pressure is present, this enables the pressure 26 in the crankcase 14 to be inferred. Thus, a determination 49 of the pressure 26 in the crankcase 14 may therefore be made with the aid of performance parameters of the electric drive 28.

In the pressure control 25 represented in FIG. 5, in order to determine the control deviation 64, the determination 49 of the pressure 26 is carried out on the basis of the performance parameters of the electric drive 28 by comparison with the desired target pressure 27. Alternatively, instead of specifying a target pressure 27, a setpoint pressure differential 66 may be specified, which is calculated from the target pressure 27 and compared with the pressure differential 51 present at the crankcase venting device 18, which was calculated with determination 49.

A standard control schema 68 operating for example according to a proportional-integral, proportional-differential or proportional-integral-differential method is applied to the control deviation 64 to calculate a correction value for the manipulated variable 41, in particular a rotational speed correction value 52, from which a new rotational speed setpoint 36 is calculated, which is supplied to the rotational speed control 30 of the electric drive 28. Changing the rotational speed setpoint 36 finally causes the actual rotational speed value 34 to change as well, thereby adjusting the volume flow 58 displaced by the pumping device 22, in order to modify the pressure 26 in the crankcase 14 particularly to shift it closer to the target pressure 27. This control section 70 thus sets a new pressure 26 in the crankcase 14.

In other respects, the second embodiment of the method for pressure control 25 represented in FIGS. 4 and 5 is the same as the first embodiment of the method for pressure control 25 represented in FIGS. 1-3 in terms of construction and function, and to this extent the preceding description thereof is referenced herewith.

Figure 6:
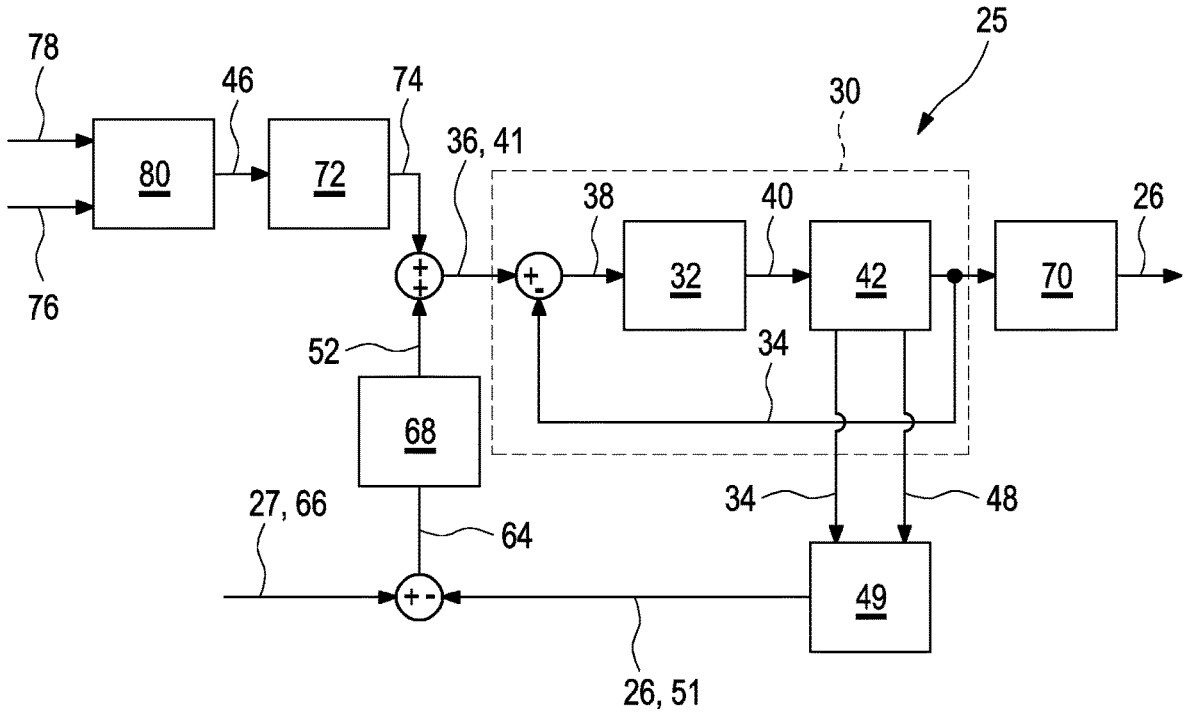
FIG. 6 is a schematic diagram of control of a pressure in the crankcase according to a third embodiment of the invention, wherein an operating point of the internal combustion is taken into account.

A third embodiment of the method for pressure control 25 represented in FIG. 6 differs from the second embodiment of the method for pressure control 25 represented in FIGS. 4 and 5 in that a determination 72 of an estimated rotational speed value 74 is carried out to accelerate the pressure control 25. A determination 80 of a typical blow-by gas volume flow 46 may be made from a rotational speed 76 of the internal combustion engine 10 and a torque 78 of the internal combustion engine 10. The estimated rotational speed value 74 that would be necessary to displace the blow-by gas volume flow 46 may be calculated from the blow-by gas volume flow 46 with the aid of the characteristic curves 47 for the pumping device 22, the oil mist separating device 24 and the electric drive 28. The estimated rotational speed value 74 is supplied to the rotational speed control 30 of the electric drive 28. In this way, the rotational speed control 30 is able to respond very quickly to anticipated changes in the blow-by gas volume flow 46, so that fluctuations in the blow-by gas 16 volume and the associated pressure fluctuations in the crankcase 14 caused by changing loads in the internal combustion engine 10 are reduced.

However, since the estimated rotational speed value 74 is only based on theoretical assumptions, it may differ from the blow-by gas volume flow 46 that actually exists. Therefore, an additional control of the pressure 26 in the crankcase 14 is needed. The rotational speed correction value 52 is determined in similar manner to the pressure control 25, as described with reference to the second embodiment.

The rotational speed setpoint 36 supplied to rotational speed control 30 is thus compiled from a total of the estimated rotational speed value 74 and the rotational speed correction value 52.

In other respects, the third embodiment of the method for pressure control 25 represented in FIG. 6 is the same as the second embodiment of the method for pressure control 25 represented in FIGS. 4 and 5 in terms of construction and function, and to this extent the preceding description thereof is referenced herewith.

Figure 7:
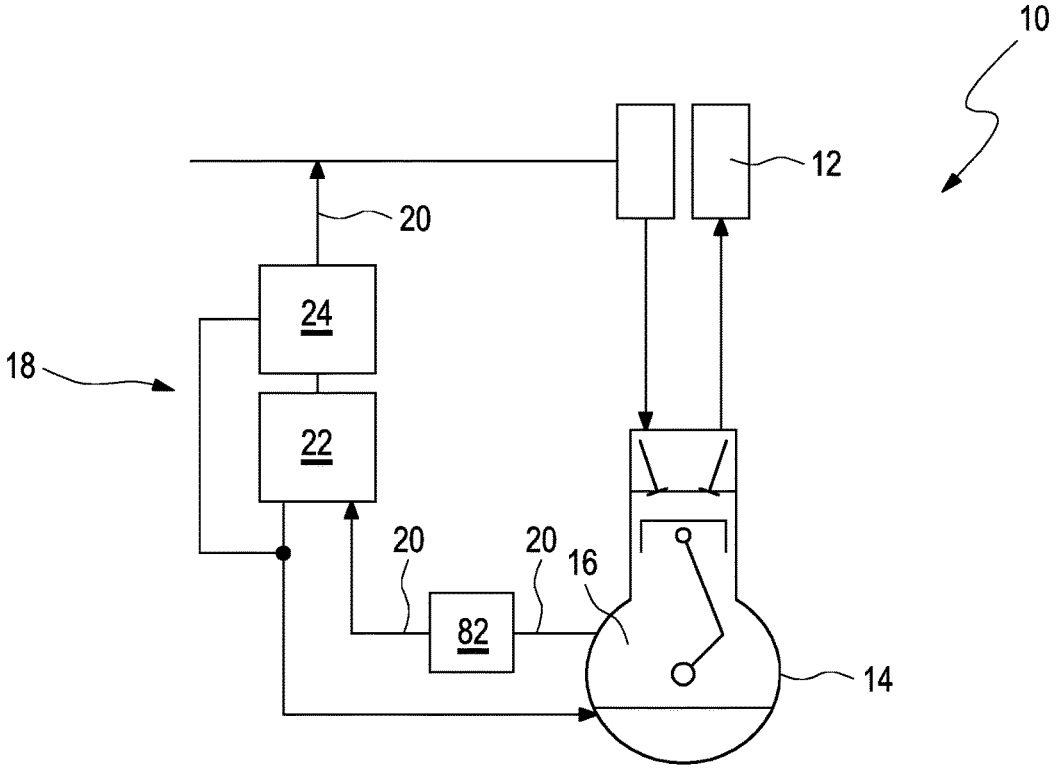
FIG. 7 is a schematic diagram of an internal combustion engine with a crankcase venting device according to a fourth embodiment of the invention.
Figure 8:
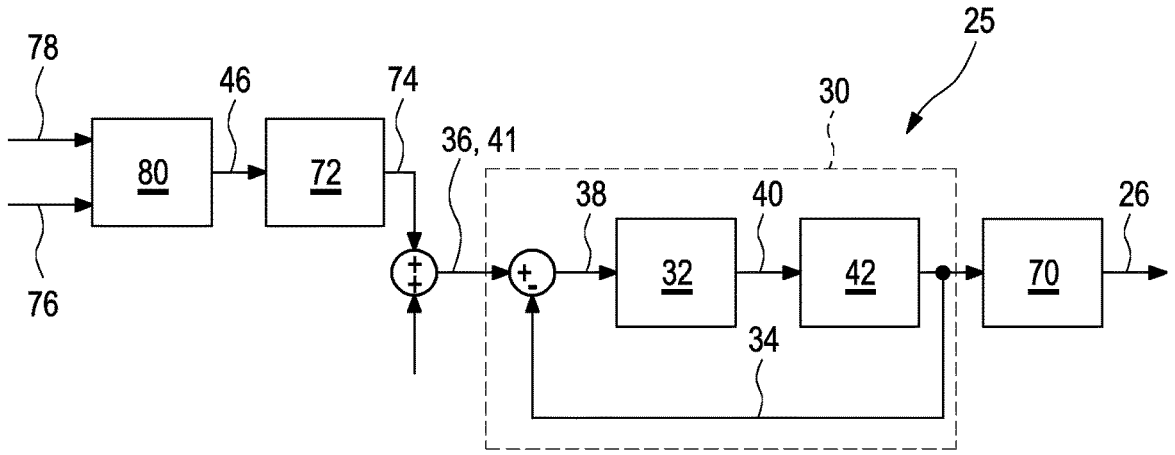
FIG. 8 is a schematic diagram of a control of the driving power of an electric drive taking into account the operating point of the internal combustion engine according to the fourth embodiment of the invention.

A fourth embodiment of the method for pressure control 25 represented in FIGS. 7 and 8 differs from the first embodiment of the method for pressure control 25 represented in FIGS. 1 to 3 in that a pressure control valve 82 is used for the pressure control 25 of pressure 26, which valve is arranged in the suction line 20 between the crankcase 14 and the pumping device 22. In addition, an estimated rotational speed value 74 is determined I similarly to the manner of the third from the operating point of the internal combustion engine 10, particularly from the rotational speed 76 of the internal combustion engine 10 and the torque 78 generated by the internal combustion engine 10. This estimated rotational speed value 74 is increased by an offset to absorb deviations from the expected blow-by gas volume flow 46. If the blow-by gas volume flow 46 is too small, the pressure 26 in the crankcase 14 falls, so that the pressure control valve 82 closes and thus temporarily interrupts the process of extracting blow-by gas 16 from the crankcase 14. This effectively prevents the pressure 26 in the crankcase 14 from falling too low.

The pressure is prevented from increasing above a permissible pressure 26 in the crankcase 14 by the addition of the offset to the estimated rotational speed value 74.

In other respects, the fourth embodiment of the method for pressure control 25 represented in FIGS. 7 and 8 is the same as the first embodiment of the method for pressure control 25 represented in FIGS. 1-3 in terms of construction and function, and to this extent the preceding description thereof is referenced herewith.

Figure 9:
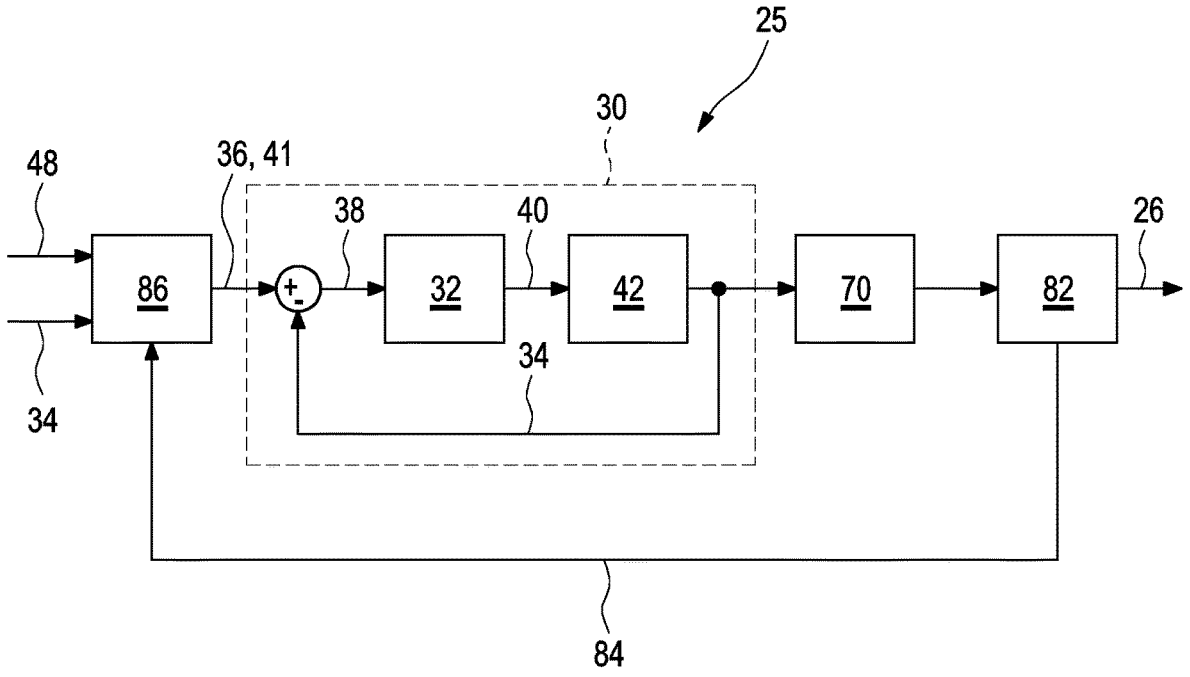
FIG. 9 is a schematic diagram of a control of the pressure in the crankcase of the internal combustion engine according to a fifth embodiment of the invention, wherein switching operations of a pressure control valve are taken into account.

A fifth embodiment of the method for pressure control 25 represented in FIG. 9 differs from the fourth embodiment of the method for pressure control 25 represented in FIGS. 7 and 8 in that an algorithm 86 for detecting switching operations 84 of the pressure control valve 82 is used in the pressure control 25.

When the pressure control valve 82 opens or closes, the pressure conditions on the inlet side of the pumping device 22 change. This in turn changes the load on the pumping device 22, so that the power required to drive the pumping device 22 also changes. This is also reflected in the performance parameters of the electric drive 28.

For example, when the pressure control valve 82 closes, the volume flow stops and the pressure differential the pumping device 22 must overcome becomes greater, with the result that the load increases. Consequently, the actual rotational speed value 34 of the electric drive 28 would fall if no rotational speed control 30 were provided. If a rotational speed control 30 is provided, this causes the actual current value 48 to rise. When the pressure control valve 82 is opened, the effects are reversed, so that opening of the pressure control valve 82 can also be detected.

Control of the pressure 26 in the crankcase 14 is preferably carried out in such manner that the rotational speed of the electric drive 28 is used as a manipulated variable 41 by supplying a rotational speed setpoint 36 to the rotational speed control 30 of the electric drive 28. The desired rotational speed setpoint 36 is determined in such manner as to ensure that the pressure control valve 82 opens and closes regularly. In this way, it may be ensured that the pressure 26 in the crankcase 14 does not increase too much. It may further be guaranteed that the output of the electric drive 28 is not too high, and that energy is not wasted unnecessarily.

The rotational speed setpoint 36 is preferably adjusted in such manner that the pressure control valve 82 opens and/or closes least once every 10 seconds, preferably at least once every 5 seconds, particularly preferably at least once every second.

Moreover, when the rotational speed setpoint 36 is calculated, it is ensured that a ratio between opening times and closing times of the pressure control valve 82 is greater than 50%, particularly preferably greater than 80%, wherein the pressure control valve 82 would be permanently open at a ratio of 100%. In this context, however, it should be noted that there should be closing times. Consequently, the ratio between opening times and closing times of the pressure control valve 82 should be less than 100%. In this way, it may be guaranteed that the pressure 26 in the crankcase 14 does not exceed the permitted value.

In other respects, the fifth embodiment of the method for pressure control 25 represented in FIG. 9 is the same as the fourth embodiment of the method for pressure control 25 represented in FIGS. 7 and 8 in terms of construction and function, and to this extent the preceding description thereof is referenced herewith.

Figure 10:
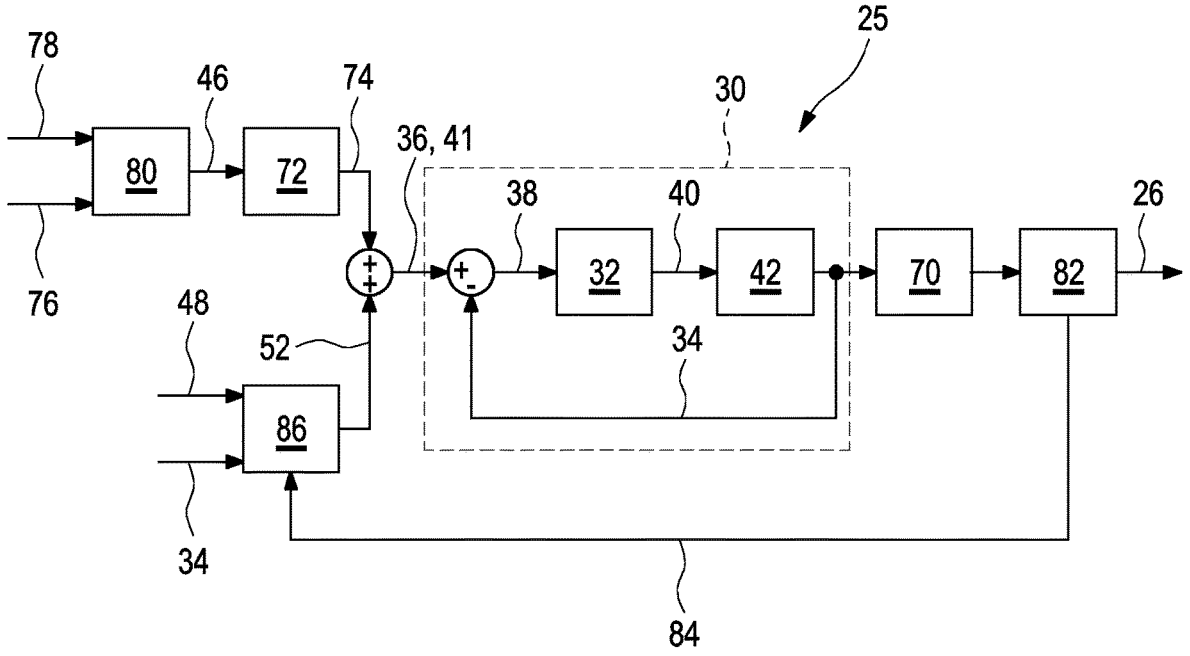
FIG. 10 is a schematic diagram of a control of the pressure in the crankcase of the internal combustion engine according to a sixth embodiment of the invention, wherein switching operations of a pressure control valve and operating points of the internal combustion engine are taken into account.

A sixth embodiment of the method for pressure control 25 represented in FIG. 10 differs from the fifth embodiment of the method for pressure control 25 represented in FIG. 9 in that the rotational speed setpoint 36 is compiled from an estimated rotational speed value 74 and a rotational speed correction value 52. The estimated rotational speed value 74 is determined in the same way as in embodiments three and four. The rotational speed correction value 52 is determined with the aid of the algorithm 86 for detecting switching operations 84 of the pressure control valve 82.

In other respects, the sixth embodiment of the method for pressure control 25 represented in FIG. 10 is the same as the fifth embodiment of the method for pressure control 25 represented in FIG. 9 in terms of construction and function, and to this extent the preceding description thereof is referenced herewith.

The invention claimed is:

1. A method for controlling a pressure in a crankcase of an internal combustion engine with a crankcase venting device, the crankcase venting device including a suction line via which a blow-by gas is removable from the crankcase, a pumping device, and an oil mist separating device, the pumping device and the oil mist separating device arranged in the suction line, the method comprising:

controlling a rotational speed of an electric drive in at least one of a closed-loop manner and an open-loop manner, the electric drive configured to drive the pumping device;

adjusting the pressure in the crankcase via manipulating the rotational speed of the electric drive; and inferring the pressure in the crankcase via evaluating at least one performance parameter of the electric drive.

2. The method according to claim 1, further comprising:

comparing an actual current value corresponding to a current supplied to the electric drive with a current setpoint; and determining a rotational speed correction value for the rotational speed of the electric drive when there is a deviation between the actual current value and the current setpoint.

3. The method according to claim 2, wherein the current setpoint corresponds to a value for the current supplied to the electric drive which maintains the rotational speed of the electric drive at a given rotational speed and the pressure in the crankcase at a target pressure.

4. The method according to claim 1, further comprising:

determining a torque generated by the electric drive and acting on the pumping device;

determining an actual rotational speed value of the electric drive, which corresponds to a rotational speed of the pumping device; and determining a pressure differential generated by the pumping device and a volume flow flowing through the pumping device from the torque acting on the pumping device and the actual rotational speed value of the electric drive.

5. The method according to claim 1, further comprising:

determining a drop in a pressure at the oil mist separating device from a volume flow flowing through the pumping device; and inferring the pressure in the crankcase from the drop in the pressure at the oil mist separating device and a pressure differential generated by the pumping device.

6. The method according to claim 4, further comprising:

determining a control deviation for the pressure in the crankcase; and determining a rotational speed correction value for the rotational speed of the electric drive based on the control deviation for the pressure in the crankcase.

7. The method according to claim 4, further comprising:

determining a notional blow-by gas volume flow generated by the internal combustion engine from a rotational speed of the internal combustion engine and a torque generated by the internal combustion engine; and determining an estimated rotational speed value based on the notional blow-by gas volume flow generated by the combustion engine such that a notional volume flow displaced by the pumping device matches the notional blow-by gas volume flow generated by the combustion engine.

8. The method according to claim 1, further comprising supplying a rotational speed setpoint including a rotational speed correction value to a control device configured to control the rotational speed of the electric drive in the at least one of the open-loop manner and the closed-loop manner.

9. The method according to claim 7, further comprising:

compiling a rotational speed setpoint from the estimated rotational speed value and a rotational speed correction value; and supplying the rotational speed setpoint including the rotational speed correction value to a control device configured to control the rotational speed of the electric drive in the at least one of the open-loop manner and the closed-loop manner.

10. The method according to claim 8, further comprising:

detecting a switch of a pressure control valve of the crankcase venting device from a performance parameter of the electric drive, the pressure control valve arranged in the suction line; and determining the rotational speed correction value based at least partially on a switching behavior of the pressure control valve.

11. An internal combustion engine comprising:

a crankcase having an internal pressure and including a crankcase venting device;

the crankcase venting device including a suction line via which a blow-by gas is removable from the crankcase, a pumping device driven by an electric drive, and an oil mist separating device, the pumping device and the oil mist separating device arranged in the suction line; and a control device configured to control a rotational speed of the electric drive in at least one of an open-loop manner and a closed-loop manner based on at least one performance parameter of the electric drive;

wherein the internal pressure of the crankcase is controllable via manipulating the rotational speed of the electric drive.

12. The method according to claim 4, wherein determining the pressure differential generated by the pumping device and the volume flow flowing through the pumping device includes using a characteristic curve of the pumping device.

13. A method for controlling a pressure in a crankcase of an internal combustion engine with a crankcase venting device, the crankcase venting device including a suction line via which a blow-by gas is removable from the crankcase, a pumping device, and an oil mist separating device, the pumping device and the oil mist separating device arranged in the suction line, the method comprising:

controlling a rotational speed of an electric drive in at least one of a closed-loop manner and an open-loop manner, the electric drive configured to drive the pumping device;

adjusting the pressure in the crankcase via manipulating the rotational speed of the electric drive;

inferring the pressure in the crankcase via evaluating at least one performance parameter of the electric drive;

comparing an actual current value corresponding to a current supplied to the electric drive with a current setpoint;

determining a rotational speed correction value for the rotational speed of the electric drive when there is a deviation between the actual current value and the current setpoint; and supplying a rotational speed setpoint including the rotational speed correction value to a control device configured to control the rotational speed of the electric drive in the at least one of the closed-loop manner and the open-loop manner.

14. The method according to claim 13, further comprising:

detecting a switch of a pressure control valve of the crankcase venting device from a performance parameter of the electric drive, the pressure control valve arranged in the suction line; and determining the rotational speed correction value based at least partially on a switching behavior of the pressure control valve.

15. The method according to claim 14, wherein the current setpoint corresponds to a value for the current supplied to the electric drive which maintains the rotational speed of the electric drive at a given rotational speed, and wherein the pressure in the crankcase corresponds to a target pressure.

16. The internal combustion engine according to claim 11, wherein the crankcase venting device further includes an actuatable pressure control valve arranged in the suction line between the crankcase and the pumping device, wherein the control device is further configured to control the rotational speed of the electric drive based on a switching behavior of the pressure control valve.

17. The internal combustion engine according to claim 11, wherein:

the pumping device is configured to displace a notional volume flow; and the control device is configured to control the rotational speed of the electric drive such that the notional volume flow displaced by the pumping device matches a notional blow-by gas volume flow of the internal combustion engine based on a rotational speed of the internal combustion engine and a torque provided by the internal combustion engine.

18. The internal combustion engine according to claim 11, wherein the pumping device is structured as a side channel blower.

19. The internal combustion engine according to claim 11, wherein the oil mist separating device is structured as an impactor.

20. The internal combustion engine according to claim 11, wherein the at least one performance parameter of the electric drive includes at least one of an electrical current supplied to the electric drive as calculated over a period of time, an electrical voltage incident on the electric drive as calculated over a period of time, and an electrical power consumption of the electric drive as calculated over a period of time.

* * * * *